US008292026B2

(12) United States Patent
Tauschek et al.

(10) Patent No.: US 8,292,026 B2
(45) Date of Patent: Oct. 23, 2012

(54) SILENCER

(75) Inventors: Thomas Tauschek, Ostfildern (DE); Arnulf Spieth, Hochdorf (DE); George Wirth, Kircheim/Teck (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 0 days.

(21) Appl. No.: 13/101,365

(22) Filed: May 5, 2011

(65) Prior Publication Data

US 2011/0272209 A1 Nov. 10, 2011

(30) Foreign Application Priority Data

May 8, 2010 (DE) ..... 10 2010 019 959

(51) Int. Cl.
*F01N 1/02* (2006.01)

(52) U.S. Cl. ..... 181/251; 181/212; 181/227; 29/890.08

(58) Field of Classification Search ..... 181/212, 181/227, 228, 269; 29/890.08
See application file for complete search history.

(56) References Cited

U.S. PATENT DOCUMENTS

| | | | | |
|---|---|---|---|---|
| 4,076,099 | A | 2/1978 | Proksch | |
| 4,501,341 | A * | 2/1985 | Jones | 181/250 |
| 7,077,922 | B2 * | 7/2006 | Brandt et al. | 156/73.1 |
| 7,870,930 | B2 * | 1/2011 | Bogard | 181/250 |
| 7,942,239 | B2 * | 5/2011 | Huff et al. | 181/266 |
| 2006/0124384 | A1 * | 6/2006 | Tary et al. | 181/243 |
| 2007/0119650 | A1 * | 5/2007 | Eide | 181/212 |
| 2008/0116004 | A1 * | 5/2008 | Muto | 181/228 |
| 2008/0196969 | A1 * | 8/2008 | Henke et al. | 181/212 |
| 2011/0017336 | A1 * | 1/2011 | Drew et al. | 138/109 |

FOREIGN PATENT DOCUMENTS

| | | | |
|---|---|---|---|
| DE | 19508217 | A1 | 9/1996 |
| DE | 102005002857 | A1 | 8/2006 |
| DE | 10 2005 026376 | A1 | 12/2006 |
| EP | 1967709 | B1 | 9/2008 |
| EP | 2 149 687 | A1 | 2/2010 |
| GB | 2 303 315 | A | 2/1997 |
| WO | WO2006131165 | A1 | 12/2006 |
| WO | WO2008018821 | A1 | 2/2008 |

* cited by examiner

*Primary Examiner* — Forrest M Phillips
(74) *Attorney, Agent, or Firm* — McGlew and Tuttle, P.C.

(57) ABSTRACT

A silencer for an exhaust system of a combustion engine, more preferably of a motor vehicle, has two end face bottoms facing away from each other, a closed circumferential jacket, at least one silencer insert, at least one inlet pipe and at least one outlet pipe. At least one of the pipes extends through the jacket into the silencer interior and is fastened to the jacket. The manufacture can be simplified if the pipe extending through the jacket has a cone, if the silencer insert on an intermediate pipe has a mating cone which engages in the cone.

39 Claims, 4 Drawing Sheets

SILENCER

CROSS REFERENCE TO RELATED APPLICATIONS

This application claims the benefit of priority under 35 U.S.C. §119 of German Patent Application DE 10 2010 019959.1 filed May 8, 2010, the entire contents of which are incorporated herein by reference.

FIELD OF THE INVENTION

The present invention relates to a silencer (also known as a muffler) for an exhaust system of a combustion engine, more preferably of a motor vehicle, with two end face bottoms facing away from each other, with a closed circumferential jacket, with at least one silencer insert, with at least one inlet pipe and with at least one outlet pipe. In addition, the invention relates to an associated manufacturing method.

BACKGROUND OF THE INVENTION

Silencers (mufflers) are divided into two manufacturing types with respect to the manufacture of their closed circumferential jacket, namely silencers in shell design and silencers in wrap design. While with the shell design two deep-drawn metal sheets are joined together at the edge, a metal sheet is wrapped and closed around a core in the case of the wrap design. Following this, a silencer insert is pushed into the wrapped jacket at the end face, that is axially and two end bottoms are attached or inserted at axial end faces distant from each other and joined to the material for instance through crimping.

In the case of a transversely positioned silencer, particularly in the case of a transversely positioned rear silencer at least one pipe, more preferably an inlet pipe, is laterally arranged so that it extends through the jacket into the interior of the silencer. This is problematic in connection with the wrap design since this laterally arranged pipe can only be assembled after the insertion of the silencer insert. For in order to be able to reliably absorb the forces occurring in operation it is necessary to support the pipe laterally introduced through the jacket both on the jacket as well as on the silencer insert located inside. This supporting on the silencer insert however can only be realized with difficulty in connection with the wrap design because of the reduced accessibility.

From WO 2006/131165 A1 a silencer of the type mentioned at the outset is known. It comprises two end face bottoms facing away from each other, a closed circumferential jacket, at least one silencer insert, at least one inlet pipe and at least one outlet pipe. There, at least one of the pipes extends through the jacket into the silencer interior. This pipe is additionally fastened to the jacket. With the known silencer this pipe is additionally fastened to the silencer insert, namely through mechanical forming. Fastening of the pipe laterally guided through the jacket to the silencer insert with the known silencer is effected for example in that a flaring tool is inserted in the pipe with which the pipe in the region of a bottom of the silencer insert through which the pipe has been passed, is flared in such a manner that the pipe is positively crimped to the bottom in radial direction.

SUMMARY OF THE INVENTION

The present invention deals with the problem of providing an improved embodiment for a silencer of the type mentioned at the outset, which is more preferably characterized by a simplified manufacturability.

The invention is based on the general idea of equipping the pipe, which protrudes through the jacket into the silencer interior with a cone (a curved surface) at its end located inside, which in the assembled state interacts with a mating cone formed on the silencer insert for supporting the pipe on the silencer insert. Through the cone engaged with the mating cone a positive support between pipe and silencer insert materializes radially and axially to the axial direction of the pipe. Both the cone as well as the mating cone can be realized comparatively easily. The positive engagement between cone and mating cone during the assembly can be likewise produced easily. In the assembled state, an adequate support is obtained for the laterally attached pipe namely on the one hand on the jacket and on the other hand by way of the cone interacting with the mating cone, also on the silencer insert. Thus, an adequate stability for the laterally arranged pipe is achieved with cost-effective manufacturability. According to the invention, the mating cone is formed on an intermediate pipe of the silencer insert.

According to an advantageous embodiment the pipe extending into the silencer interior can be attached so that subject to axial preload it is supported on the silencer insert via the cone engaged with the mating cone. Through the preload any play between cone and mating cone is eliminated, as a result of which relative movements between pipe and silencer insert can also be prevented. The supporting effect for the respective pipe is improved as a result.

According to a special embodiment the axial preload, with which the pipe supports itself on the silencer insert, can be specifically selected so that an axial minimum preload is retained over the entire expected thermal operating range of the silencer. Because of this, particularly thermal expansion effects can be taken into account, so that an adequate stability for the silencer can be guaranteed with all operating states.

The cone and the mating cone can be matched to each other so that the cone engages in the mating cone. Then the cone, at least on its outer contour, can be configured in the shape of a cone segment or ball segment. Matching to this, the mating cone at least on its inner contour can be configured in the shape of a cone segment or ball segment or funnel shaped. Alternatively, cone and mating cone can be configured so that the mating cone engages in the cone. Then the cone, at least on its inner contour, can be configured in the shape of a cone segment or ball segment. Matching to this, the mating cone at least on its outer contour can be configured in the shape of a cone segment or ball segment or funnel shaped. Provided that the cone has a ball segment shaped outer contour, particularly position tolerances, which can occur within the scope of the manufacture, can be easily compensated since the pipe in this case does not need to be assembled exactly coaxially to the mating cone of the silencer insert in order to achieve the desired supporting effect. The same applies also in the event that the mating cone has a ball segment shaped outer contour.

Practically, the intermediate pipe in the silencer insert can be arranged so that it fluidically connects the inlet pipe to the outlet pipe. Optionally it can be provided to fluidically connect the intermediate pipe to a branch-off pipe which terminates in a resonance chamber. According to a further development, this resonance chamber can be fluidically connected to an additional chamber via at least one connecting pipe, as a result of which for example the volume of the resonant chamber can be significantly enlarged. Optionally, the additional chamber can be connected to a further pipe which can be a further outlet pipe.

With simple embodiments, which are characterized by a particularly simple assemblability, the cone can be formed at an end of the pipe penetrating the jacket located inside facing the intermediate pipe. Likewise, the mating cone can be formed at an end of the intermediate pipe facing the respective pipe penetrating the jacket. With another embodiment, which makes possible a stronger lateral or radial support between the pipe penetrating the jacket and the intermediate pipe, the cone can be positioned spaced from the end located inside, so that an end portion protruding over the cone exists, which is inserted into the intermediate pipe through the mating cone or into which the mating cone is inserted. Additionally or alternatively the mating cone can be arranged spaced from the end of the intermediate pipe so that an end portion protruding over the mating cone engages over the pipe penetrating the jacket in axial direction in such a manner that the cone is inserted in this end portion of the intermediate pipe in order to be able to engage into the mating cone or in such a manner that this end portion of the intermediate pipe is inserted through the cone into the respective pipe in order to be able to engage in the cone.

According to another embodiment the cone can have several protrusions arranged distributed in circumferential direction, via which the cone is supported on the mating cone. Because of this, position tolerances and shape tolerances between cone and mating cone can be better compensated. More preferably, passage openings in circumferential direction between these protrusions between cone and mating cone can remain open. Alternatively it is also possible to equip the mating cone with several protrusions arranged distributed in circumferential direction, via which the mating cone is supported on the cone.

Additionally or alternatively it can be provided according to another embodiment that the cone comprises several slits arranged distributed in circumferential direction, which extend axially, which are axially open on one side and which in circumferential direction separate several cone segments from one another. Through this measure, the cone receives an increased radial spring elasticity in the region of its cone segments, which simplifies the insertion operation for the engagement between cone and mating cone. In addition or alternatively the mating cone can comprise several slits arranged distributed in circumferential direction which extend axially, which are axially open on one side and which in circumferential direction separate several mating cone segments from one another, as a result of which the mating cone possesses an increased radial spring elasticity in the region of the mating cone segments.

It is to be understood, that the features mentioned above and still to be explained in the following cannot only be used in the respective combination stated, but also in other combinations or by themselves without leaving the scope of the present invention.

Preferred exemplary embodiments of the invention are shown in the drawings and are explained in more detail in the following description, wherein same reference characters refer to same or similar of functionally same components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
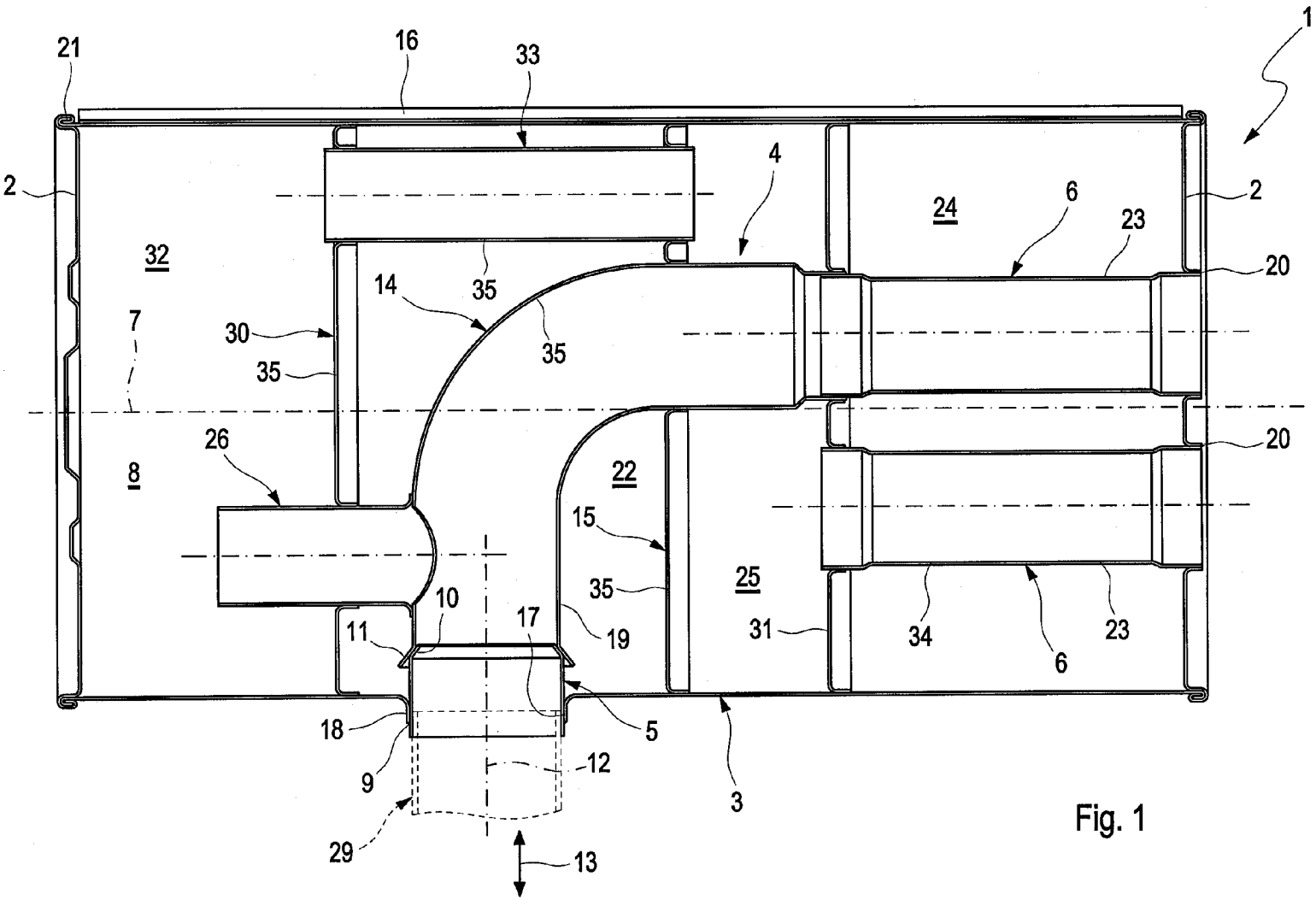
FIG. 1 is a highly simplified longitudinal sectional view through a silencer according to the invention.

Referring to the drawings in particular, according to FIG. 1, a silencer 1 comprises two end face bottoms 2 facing away from each other, a closed circumferential jacket 3, at least one silencer insert 4, at least one inlet pipe 5 and at least one outlet pipe 6.

The silencer 1 is intended for installation in an exhaust system of a combustion engine which is not shown and can more preferably be used in a motor vehicle. Preferentially, the silencer 1 is a rear silencer, that is the silencer which, within the exhaust system or with respect to the exhaust gas flow direction, is the silencer through which the flow flows last before the exhaust gas reaches the respective tailpipe of the exhaust system which comprises the mouth of the exhaust system to the environment. Particularly advantageously the silencer is a silencer arranged positioned horizontally in the assembled state. With the transversely positioned silencer 1 an axial direction 7 of the silencer 1 substantially extends parallel to a horizontal transverse direction of the vehicle. In order to be able to more easily install the silencer 1 transversely in the vehicle, at least one of the pipes, that is at least one inlet pipe 5 and/or one outlet pipe 6 extends through the jacket 3 into the silencer interior 8. In the shown example exactly one pipe, namely the inlet pipe 5 extends through the jacket 3.

Preferably only a single inlet pipe 5 is also provided. In contrast with this, more than one outlet pipe 6 can also be provided. The example of FIG. 1 shows two outlet pipes 6. Although in the following description only the inlet pipe 5 is the pipe 5, 6 laterally penetrating the jacket 3 every time, the outlet pipe 6, with another embodiment with opposite flow direction, can also be the pipe 5, 6 laterally penetrating the jacket 3. An embodiment, wherein both at least one inlet pipe 5 as well as least one outlet pipe 6 are laterally arranged and penetrate the jacket 3 is likewise possible. Optionally, all feeding or discharging pipes 5, 6 can be laterally connected to the jacket 3.

The inlet pipe 5 is fastened to the jacket 3. In the example, at least one welded connection 9 is provided with which the inlet pipe 5 is fastened to the jacket 3. This can for example be a closed ring-shaped circumferential weld seam, as a result of which a gas-tight connection is created at the same time. Alternatively it is likewise possible for example during the manufacture of the silencer 1 to fasten the inlet pipe 5 to the jacket 3 by means of at least one spot weld or a tack weld. When installing the silencer 1 in an exhaust system a corresponding feed pipe 29 can then be connected to the inlet pipe 5. When fastening the feed pipe 29 a circumferential weld seam can then be created. The provision of a three-sheet seam, which simultaneously interconnects three metal sheets, i.e. the inlet pipe 5, the jacket 3 and the feed pipe 29 is then preferred.

The inlet pipe 5 to this end penetrates an opening 17 laterally worked into the jacket 3. The respective welded connection 9 in this case can be formed at a end face of a collar 18 extended outwardly, which surrounds the opening 17.

In the interior 8 the inlet pipe 5 has a cone 10 which is in engagement with a mating cone 11 shaped fittingly or complementarily thereto, which is provided on the silencer insert 4. Through this positive engagement between the cone 10 and the mating cone 11 suitably formed thereto, a radial and axial support on the silencer insert 4 is obtained for the inlet pipe 5 or its pipe longitudinal axis 12. Thus the inlet pipe 5 on the one hand is supported on the jacket 3 and on the other hand, spaced from the latter, on the silencer insert 4 via the cone 10 engaging in the mating cone 11. Because of this, the inlet pipe 5 can absorb moments and easily support the forces that occur in operation.

With all shown examples of FIG. 1 to 12 the cone 10 in each case is inserted in the mating cone 11, so that the cone 10 engages in the mating cone 11. This embodiment is more preferably suitable for the assembly of the silencer 1. In principle, however, an inverted design is also conceivable wherein the cone 10 is fitted onto the mating cone 11 or wherein the mating cone 11 is inserted into the cone 10 or engages therein. This inverted design—so far as practical—can be realized with all embodiments for the configurations of cone 10 and mating cone 11 that are described above and in the following.

It is particularly advantageous if the inlet pipe 5 is provided so that it is supported on the silencer insert 4 subject to a preload that is axial with respect to the pipe longitudinal axis 12. This axial preload is indicated in FIG. 1 by a double arrow and designated 13. The axial preload 13 acts between the silencer insert 4 and the jacket 3 and is transmitted via the inlet pipe 5 between the jacket 3 and the silencer insert 4. In other words, the inlet pipe 5 with its cone 10 engages in the mating cone 11 subject to the axial preload 13.

Preferred, in this case, is an embodiment wherein the axial preload 13 is not randomly selected but has a predetermined value. More preferably, the axial preload 13 can be specifically set to a dimension that an axial minimum preload for the entire temperature range to be expected during the silencer operation is guaranteed. The thermal operating range in a vehicle application can range from minus 40° C. to plus 500° C., provided it is a rear silencer.

The cone 10 is practically formed integrally on the inlet pipe 5. For example, the end of the inlet pipe 5 located on the inside is formed for producing the cone 10. In principle, however, a built version is also possible.

The mating cone 10 is formed on an intermediate pipe 14 of the silencer insert 4. This intermediate pipe 14 in this case is fastened to an intermediate bottom 15 of the silencer insert 4 which is arranged between the two end bottoms 2.

Practically, the mating cone 11 is integrally formed on the intermediate pipe 14. A built embodiment is likewise possible. Practically, the intermediate pipe 14 is configured so that in the region of the mating cone 11 it yields spring-elastically in the pipe longitudinal axis 12. This spring-elastic yield simplifies the generation of the axial preload 13. On assembly, the intermediate pipe 14 is quasi tensioned like a spring in order to generate the preload 13. In order to be able to generate a comparatively high preload 13, the intermediate pipe 14 is designed with a comparatively high spring stiffness or stability. This can be realized for example in that the intermediate pipe 14 is curved as in the shown example and supported on two intermediate bottoms 15 and 30.

The jacket 3 is formed through the wrapping of a sheet metal part. Accordingly, this is a silencer 1 produced according to the wrapping construction method. For example, the jacket 3 can have a longitudinal seam 16, which extends parallel to the silencer longitudinal axis 7. Practically, the longitudinal seam 16 is positioned on a side facing away from the inlet pipe 5.

At least one of the end bottoms 2, in this case the end bottom 2 shown on the right in FIG. 1, can be a component part of the silencer insert 4. In accordance with the wrapping construction method of the silencer 1, the silencer insert 4 is axially inserted into the jacket 3, that is parallel to the silencer longitudinal axis 7 and thus at the end face. Here it can be practically provided to match the outer dimension of the insert 4 and the inner dimension of the jacket so that the silencer insert 4 with respect to the silencer longitudinal axis 7 rests against or is held on the jacket 3 under radial preload.

The respective outlet pipe 6 extends through one of the end bottoms 2, in this case the end bottom 2 shown on the right in FIG. 1, which in the example is part of the silencer insert 4. In addition, the respective outlet pipe 6 in the example extends through a further intermediate bottom 31, which in this case is likewise provided for positioning and stabilising the intermediate pipe 14. The respective outlet pipe 6 is at least fastened to the end bottom 2 for example by means of a welded connection 20, in order to also realize a gas-tight connection here. The end bottoms 2 are axially attached to the jacket 3 or inserted therein and connected to the jacket 2 in a fixed manner, for example with a circumferential crimp connection 21.

According to FIG. 1, the cone 10, in the circumferential direction of the inlet pipe 5, can support itself on the mating cone 11 in a ring-shaped closed manner. As a result, a radial support of the inlet pipe 5 on the silencer insert 4 is possible in every direction.

As can be seen from FIG. 1, cone 10 and mating cone 11 are arranged spaced from the jacket 3. This is achieved through a positioning of the free end 19 of the intermediate pipe 14 facing the respective pipe 5 spaced from the jacket 3 in the pipe longitudinal axis 12 relative to the jacket 3. Transversely to the pipe longitudinal axis 12 the intermediate pipe 14 is supported on the intermediate bottoms 15, 30. More preferably, the intermediate pipe 14 is arranged approximately in the middle in the silencer interior 8, namely with respect to the pipe longitudinal axis 12.

The inlet pipe 5 is axially open so that the exhaust gas can flow into the intermediate pipe 14 through the cone 10 and through the mating cone 11. In the example, the inlet pipe 5 protrudes through the jacket 3 into a chamber 22, which is formed in the silencer interior 8 with the help of the silencer insert 4. Said chamber 22 is laterally delimited by the intermediate walls 15, 30 and by a portion of the jacket 3. The intermediate walls 15, 30, 31 can be configured permeable to gas or permeable to sound, for example by means of openings or by means of a perforation. The one outlet pipe 6 in the shown example is fluidically connected to the inlet pipe 5 via the intermediate pipe 14 and leads out of the silencer 1. At least one of the outlet pipes 6 can have a perforation 23 in order to communicate with a chamber 24, which is formed between the intermediate wall 31 and the neighboring end bottom 2. The intermediate wall 31 can also be configured permeable to gas or permeable to sound for example by means of a perforation in order to enlarge the volume of the chamber 24 as far as to the intermediate bottom 15 so that for example a chamber 25, which is formed between the intermediate bottoms 15 and 31, can be utilized for example as adsorption chamber.

According to FIG. 1, the intermediate pipe 14 connects the inlet pipe 15 with the one outlet pipe 6. Thus the exhaust gas can flow to the silencer 1 directly and thus without major loss of pressure. Insofar—as is the case here—the inlet pipe 5 penetrates the jacket 3 and the respective outlet pipe 6 penetrates one of the end bottoms 2, the intermediate pipe 14 is practically bent. In the example of FIG. 1 the intermediate pipe 14 has a bend of approximately 90°. Accordingly, it generates a flow deflection by approximately 90°.

The intermediate pipe 14 according to FIG. 1 can be fluidically connected to a branch-off pipe 26. The branch-off pipe 26 terminates in a resonance chamber 32. The resonance chamber 32 in the example is axially delimited by the one intermediate bottom 30 and by the end bottom 2 adjacent thereto and in circumferential direction by the jacket 3. Because of this, a Helmholtz resonator is created. The resonance chamber 32 can now be fluidically connected to the chamber 25 via at least one connecting pipe 33, which chamber is also called additional chamber 25 in the following. To this additional chamber 25 a further pipe 34 is connected which in the example is a further outlet pipe 6. It is thus possible that exhaust gas from the intermediate pipe 14 reaches the additional chamber 25 via the branch-off pipe 26, through the resonance chamber 32, via the connecting pipe 33 and exits the silencer 1 via the further outlet pipe 6 or 34.

The chamber 22, which in the following can also be called intermediate chamber 22, can be optionally coupled in a sound-transmitting manner to the resonance chamber 32 and/or to the additional chamber 25 and/or to the interior of the connecting pipe 33 and/or to the interior of the intermediate pipe 14. The respective sound-transmitting connection can for example be realized by means of a perforation 35, which is formed in the intermediate bottom 30 separating the intermediate chamber 22 from the resonance chamber 32. Likewise, such a perforation 35 can be formed in the intermediate bottom 15 separating the intermediate chamber 22 from the additional chamber 25. Likewise, the connecting pipe 33 can have such a perforation. Finally, the intermediate pipe 14 can also have such a perforation 35 as a matter of principle.

With low exhaust flow rates the flow flows largely directly from the inlet pipe 5 via the intermediate pipe 14 to the outlet pipe 6 through the silencer 1. With larger flow rates, an increasing additional exhaust gas flow can form via the branch-off pipe 26, the connecting pipe 33 and the further outlet pipe 6.

According to the FIGS. 2 to 12, different configurations or embodiments can be realized for the cone 10 and the mating cone 11. For example, the cone 10 can have a cone segment shaped outer contour 27 according to the FIGS. 2 and 6 to 8. According to the FIGS. 3 to 5, the outer contour 27 of the cone 10 can also be configured in the shape of a wall segment. Other shapes are likewise conceivable for the outer contour 27.

According to the FIGS. 2 and 6 to 8 the mating cone 11 can have a cone segment shaped inner contour 28. With angles matched to one another and coaxial alignment of cone 10 and mating cone 11 a particularly intensive areal and ring-shaped closed support of the inlet pipe 5 on the intermediate pipe 14 is obtained.

Figure 5:
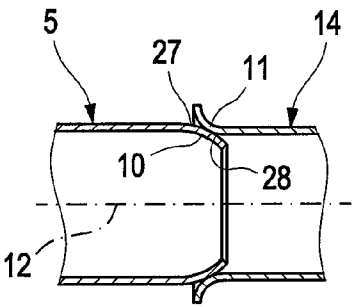
FIG. 5 is a longitudinal sectional view of the silencer in the region of a laterally arranged pipe showing another embodiment.
Figure 4:
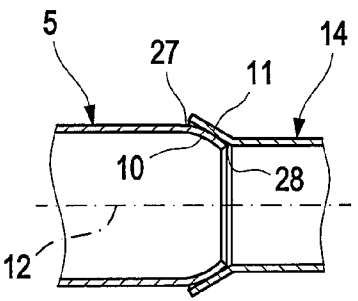
FIG. 4 is a longitudinal sectional view of the silencer in the region of a laterally arranged pipe showing another embodiment.

The mating cone 11 however can also have a ball segment shaped inner contour 28 according to FIG. 4 or a funnel shaped inner contour 28 according to FIG. 5. The funnel shaped inner contour 28 according to FIG. 5 is characterized relative to the ball segment shaped inner contour 28 from FIG. 4 and relative to the cone segment shaped inner contour 28 of the FIGS. 2 and 6 to 8 in that the inner contour 28 has a curved profile which is convex towards the cone 10.

Figure 3:
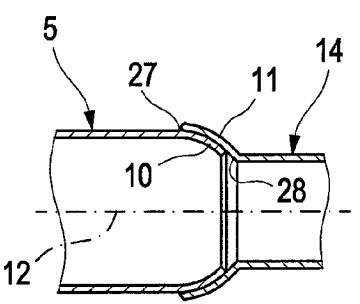
FIG. 3 is a longitudinal sectional view of the silencer in the region of a laterally arranged pipe showing another embodiment.
Figure 2:
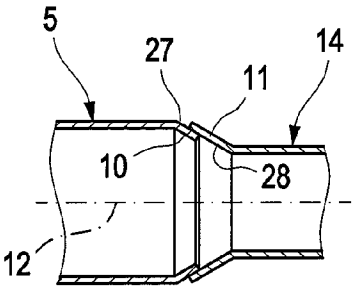
FIG. 2 is a longitudinal sectional view of the silencer in the region of a laterally arranged pipe showing an embodiment.

With the embodiments of FIGS. 3 to 5 a cone 10 with ball segment shaped outer contour 27 meets a cone segment shaped inner contour (FIG. 3) or a ball segment shaped inner contour (FIG. 4) or a funnel shaped inner contour (FIG. 5) of the mating cone 11. With these embodiments, a linear contact between cone 10 and mating cone 11 that is closed in circumferential direction also occurs even if no exact coaxial alignment between cone 10 and mating cone 11 is present. These embodiments thus make possible a compensation of manufacturing tolerances. The embodiment according to FIG. 3, wherein a ball segment shaped outer contour 27 of the cone 10 interacts with a cone segment shaped inner contour 28 of the mating cone 11 is preferred here. This embodiment can be realized comparatively cost-effectively.

With the embodiments of FIGS. 1 to 5 and 7 the cone 10 in each case is formed at an end of the inlet pipe 5 located inside. Furthermore, with the embodiments of FIG. 1 to 6, the mating cone 11 in each case is formed at an end 19 of the intermediate pipe 14 facing the inlet pipe 5.

Figure 6:
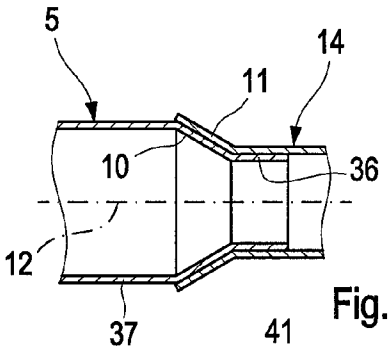
FIG. 6 is a longitudinal sectional view of the silencer in the region of a laterally arranged pipe showing another embodiment.
Figure 8:
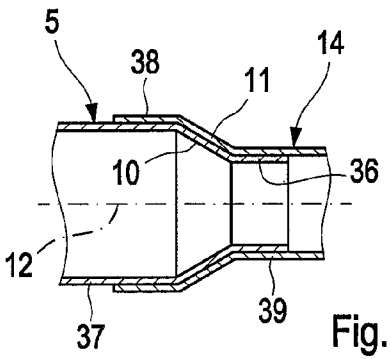
FIG. 8 is a longitudinal sectional view of the silencer in the region of a laterally arranged pipe showing another embodiment.

With the embodiments of FIGS. 6 and 8 the cone 10 is formed between an end portion 36 of the inlet pipe 5 located inside and a portion 37 of the inlet pipe 5 which is fastened to the jacket 3. Accordingly, the cone 10 with these embodiments is positioned spaced from the axial end of the inlet pipe 5 located inside. The end portion 36, which axially protrudes over the cone 10, forms an insertion portion which can be inserted into the intermediate pipe 14 through the mating cone 11. Here, the outer dimension of the end portion 36 and the inner dimension of the intermediate pipe 14 can be matched to each other so that only a small play or no play or even a force fit materializes. With the help of such an end portion 36 dipping into the intermediate pipe 14 the radial support of the inlet pipe 5 on the remaining silencer insert 4 via the intermediate pipe 14 can be significantly improved.

Figure 7:
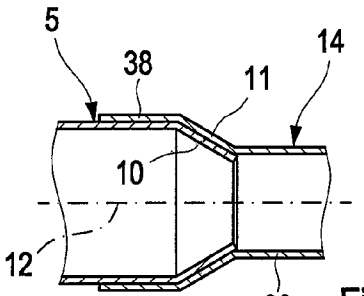
FIG. 7 is a longitudinal sectional view of the silencer in the region of a laterally arranged pipe showing another embodiment.

Additionally or alternatively it is possible according to FIGS. 7 and 8 to form the mating cone 11 between an end portion 38 of the intermediate pipe 14 facing the inlet pipe 5 and a portion 39 of the intermediate pipe 14, via which the intermediate pipe 14 is fastened to the silencer insert 4. In other words, the mating cone 11 with these embodiments is arranged spaced from the end 19 of the intermediate pipe 14 facing the inlet pipe 5. The end portion 38 of the intermediate pipe 14 axially protruding over the mating cone 11 is dimensioned so that it can be fitted onto the inlet pipe 5 from the outside. In other words, the inlet pipe 5 with its cone 10 is inserted into the end portion 38 of the intermediate pipe 14 in order to engage with the mating cone 11. Practically, the outer dimension of the inlet pipe 5 and the inner dimension of the end portion 38 can also be matched to each other in this case that a minor radial play or no radial play or even a force fit is formed. This measure, too, leads to a stiffening of the coupling between inlet pipe 5 and intermediate pipe 14 which improves the radial support of the inlet pipe 5 on the silencer insert 4 via the intermediate pipe 14.

With the embodiment shown in FIG. 6 only the inlet pipe 5 has an end portion 36 protruding over the cone 10. With the embodiment shown in FIG. 7 only the intermediate pipe 14 has an end portion 38 protruding over the mating cone 11. With the embodiment shown in FIG. 8 both the inlet pipe 5 has an end portion 36 protruding over the cone 10 and the intermediate pipe 14 also has an end portion 38 protruding over the mating cone 11.

Figure 9:
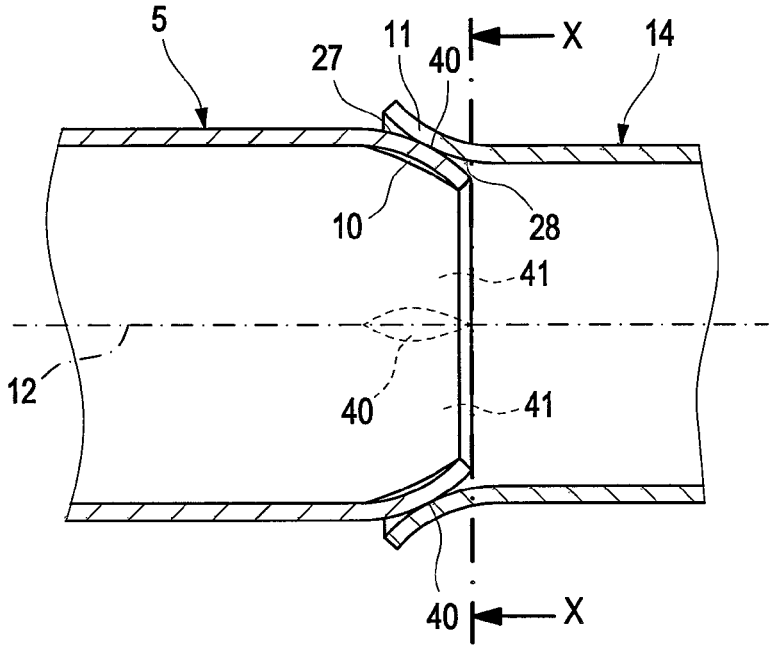
FIG. 9 is a longitudinal sectional view of the silencer as in FIGS. 2 to 8 however with a further embodiment.
Figure 10:
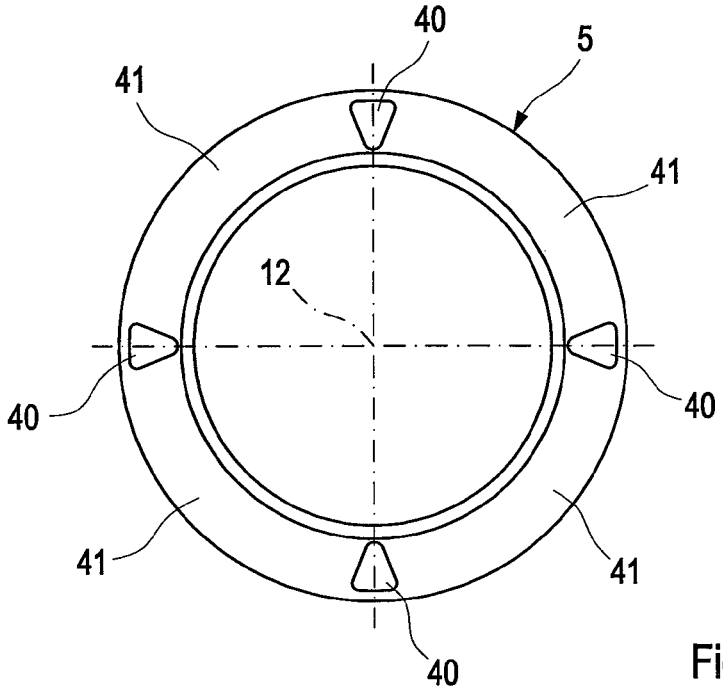
FIG. 10 is a cross sectional view corresponding to the section lines X in FIG. 9.

According to FIGS. 9 and 10, the cone 10 can have several protrusions 40 distributed in the circumferential directions, which relative to the remaining outer contour 27 protrude to the outside. Via these protrusions 40, the cone 10 supports itself on the mating cone 11. More preferably, passage openings 41 can form in the circumferential direction between the protrusions 40 as a result. In the example, purely exemplarily, exactly four such protrusions 40 are provided which are additionally arranged symmetrically distributed in the circumferential direction. It is clear, that at least three such protrusions 40 are present, while the quantity of the protrusions 40 is practically restricted to fifteen or ten. Alternatively it is likewise possible to equip the mating cone 11 with such protrusions which then protrude from the inner contour 28 to the inside.

Figure 11:
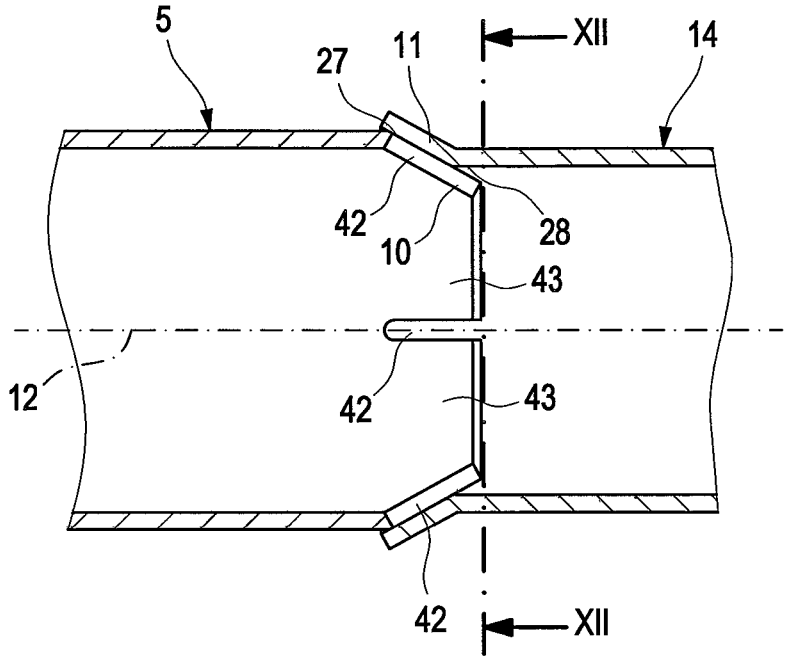
FIG. 11 is a longitudinal sectional view as in FIG. 9, however with another embodiment.
Figure 12:
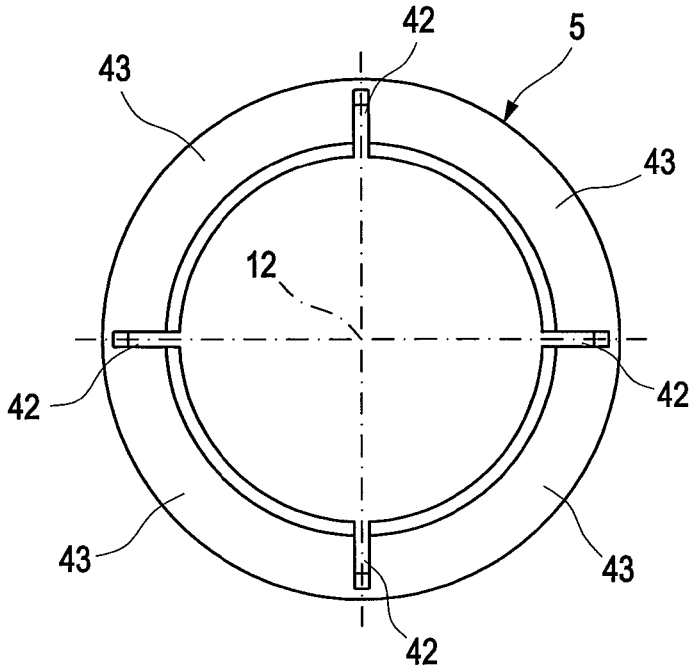
FIG. 12 is a cross sectional view corresponding to section lines XII in FIG. 11.

According to FIGS. 11 and 12, according to another option, several slits 42 arranged distributed in circumferential direction can be formed on the cone 10, each of which extend axially and which are each open on one end and which subdivide the cone 10 into several cone segments 43 in the circumferential direction. In other words, the slits separate the cone segments 43 from one another in circumferential direction. As a result, the cone 10 receives an increased radial spring elasticity within the cone segments 43. Because of this, an improved support can be realized. In addition or alternatively, the mating cone 11 can likewise be equipped with such slits, which are arranged distributed in circumferential direction, extend axially, are axially open on one end and which subdivide the mating cone 11 into several mating cone segments in circumferential direction. In the example of FIGS. 11 and 12, without restriction of the generality, exactly four such slits 42 are formed, which are additionally arranged distributed symmetrically. It is clear that more or fewer than four such slits 42 can also be realized.

The measures introduced above with reference to FIGS. 9 to 12 can also be combined so that for example a protrusion 40 can be arranged on the respective cone segment 43 between two neighbouring slits 42 in circumferential direction. In addition, the measures introduced in FIGS. 9 to 12 can also be combined with the configuration introduced in FIGS. 2 to 8.

The protrusions 40 or the slits 42 simplify a tolerance compensation and improve the supporting effect between cone 10 and mating cone 11.

The silencer introduced here can be preferentially produced as follows:

Initially, the respective silencer insert 4 is pushed into the jacket 3 at the end face, that is parallel to the silencer longitudinal axis 7. Following this, the inlet pipe 5 is laterally inserted into the opening 17 of the jacket 3, namely so far until the cone 10 and the mating cone 11 are engaged with each other. After this, the inlet pipe 5 is fastened to the jacket 3.

Preferably, prior to the fastening of the inlet pipe 5 to the jacket 3, the inlet pipe 5 in this case is inserted through the opening 17 into the silencer interior 8 until the inlet pipe 5 via the cone 10 engaged with the mating cone 11 is supported on the silencer insert 4 with the axial preload 13, more preferably with the predetermined axial preload 13. Fastening of the inlet pipe 5 to the jacket 3, that is more preferably the provision of the welded connection 9, is then carried out with axial preload 13 maintained, that is while the inlet pipe 5 is supported axially preloaded on the silencer insert 4. Because of this, the previously, more preferably specifically applied preload 13 can be preserved.

While specific embodiments of the invention have been shown and described in detail to illustrate the application of the principles of the invention, it will be understood that the invention may be embodied otherwise without departing from such principles.

What is claimed is:

1. A silencer for a motor vehicle exhaust system of a combustion engine, the silencer comprising:

two end face bottoms facing away from each other;

a closed circumferential jacket;

a silencer insert;

an inlet pipe;

an outlet pipe, wherein:

at least one of said inlet pipe and said outlet pipe extends through the jacket into a silencer interior and is fastened to said jacket;

said pipe extending through said jacket has a cone;

said silencer insert has an intermediate pipe having a mating cone;

said cone and said mating cone engage each other; and said jacket contacts said silencer insert in a preloaded manner.

2. A silencer according to claim 1, wherein said pipe extending through said jacket is attached so as to be supported on said silencer insert under axial preload via said cone interacting with said mating cone.

3. A silencer according to claim 2, wherein said inlet pipe and said outlet pipe supports itself on said silencer insert under a predetermined axial preload.

4. A silencer according to claim 3, wherein said axial preload can be selected so that over an entire expected thermal operating range of the silencer an axial minimum preload is retained.

5. A silencer according to claim 1, wherein said cone engages in said mating cone or said mating cone engages in said cone.

6. A silencer according to claim 1, wherein said cone has a cone segment shaped or ball segment shaped outer contour or inner contour.

7. A silencer according to claim 1, wherein said mating cone has a cone segment shaped or ball segment shaped or funnel shaped inner contour or outer contour.

8. A silencer according to claim 1, wherein said mating cone is formed complementarily to said cone.

9. A silencer according to claim 1, wherein said cone is integrally formed on one of said inlet pipe and said outlet pipe.

10. A silencer according to claim 1, wherein said mating cone is integrally formed on said intermediate pipe.

11. A silencer according to claim 1, wherein said intermediate pipe is at least one of configured and attached so that in a region of said mating cone parallel to a longitudinal axis of said pipe comprising said cone said mating cone yields spring-elastically.

12. A silencer according to claim 1, wherein said intermediate pipe is bent and generates a flow deflection of 90°.

13. A silencer according to claim 1, wherein the intermediate pipe fluidically connects the inlet pipe to the outlet pipe.

14. A silencer according to claim 1, wherein the intermediate pipe is fluidically connected to a branch-off pipe terminating in a resonance chamber.

15. A silencer according to claim 14, wherein the resonance chamber is fluidically connected to an additional chamber via at least one connecting pipe.

16. A silencer according to claim 15, wherein the additional chamber is fluidically connected to a further pipe, said further pipe being one of an internal pipe and a further outlet pipe.

17. A silencer according to claim 15, wherein at least one of the intermediate pipe and the additional chamber and the resonance chamber and the connecting pipe is connected to an intermediate chamber in a sound transmitting manner, in which intermediate chamber said one of said inlet pipe and said outlet pipe extending through the jacket.

18. A silencer according to claim 1, wherein said cone is formed at least one of on an end of said one of said inlet pipe and said outlet pipe extending through the jacket located inside between an end portion of said one of said inlet pipe and said outlet pipe extending through the jacket located inside and a portion of that pipe fastened to the jacket.

19. A silencer according to claim 18, wherein said end portion dips into the intermediate pipe through the mating cone or the mating cone is inserted into the end portion.

20. A silencer according to claim 1, wherein said mating cone is formed on an end of the intermediate pipe facing said one of said inlet pipe and said outlet pipe extending through the jacket or is formed between an end portion of the intermediate pipe facing said one of said inlet pipe and said outlet pipe extending through the jacket and a portion of the intermediate pipe fastened to the silencer insert.

21. A silencer according to claim 20, wherein said cone is inserted in said end portion or that said end portion dips into said one of said inlet pipe and said outlet pipe extending through the jacket through said cone.

22. A silencer according to claim 1, wherein said jacket is formed through wrapping of a metal sheet part.

23. A silencer according to claim 1, wherein said jacket has a longitudinal seam.

24. A silencer according to claim 23, wherein said longitudinal seam is located on a side facing away from said one of said inlet pipe and said outlet pipe extending through the jacket.

25. A silencer according to claim 1, wherein at least one of said two end face bottoms forms a component part of the silencer insert.

26. A silencer according to claim 1, wherein said silencer insert is inserted in said jacket at a jacket end face.

27. A silencer according to claim 1, wherein the other of said one of said inlet pipe and said outlet pipe extending through the jacket extends through one of said two end face bottoms and is fastened to said one of said two end face bottoms.

28. A silencer according to claim 1, wherein said cone supports itself on the mating cone in a ring-shaped closed manner in circumferential direction of the respective pipe.

29. A silencer according to claim 1, wherein said cone and said mating cone are spaced from said jacket.

30. A silencer according to claim 1, wherein said one of said inlet pipe and said outlet pipe extending through the jacket is fluidically connected, through said cone and through said mating cone, with a chamber formed in the silencer interior by said silencer insert.

31. A silencer according to claim 1, wherein said cone has several protrusions arranged distributed in circumferential direction via which said cone is supported on said mating cone, so that in a circumferential direction between said protrusions passage openings between said cone and said mating cone remain clear.

32. A silencer according to claim 1, wherein said mating cone comprises several protrusions arranged distributed in circumferential direction, via which said mating cone is supported on said cone.

33. A silencer according to claim 32, wherein said mating cone is supported on said cone in a circumferential direction between said protrusions; and passage openings between said cone and said mating cone remain clear.

34. A silencer according to claim 1, wherein said cone comprises several slits arranged distributed in a circumferential direction which extend axially, which are axially open on one side and which in the circumferential direction separate several cone segments from one another.

35. A silencer according to claim 1, wherein said mating cone comprises several slits arranged distributed in a circumferential direction which extend axially, which are axially open on one side and which in the circumferential direction separate several mating cone segments from one another.

36. A method for producing a silencer for a motor vehicle exhaust system of a combustion engine, the method comprising the steps of:

pushing at least one silencer insert into a closed circumferential jacket at an end face of the closed circumferential jacket, wherein said jacket engages said silencer insert in a preloaded manner;

laterally inserting at least one of an inlet pipe and an outlet pipe in an opening of the jacket so far until a cone at the preceding end of the at least one of the inlet pipe and the outlet pipe and a mating cone formed on an intermediate pipe of the silencer insert engage with each other; and fastening the at least one of an inlet pipe and the outlet pipe wherein the respective pipe is fastened to the jacket.

37. A method according to claim 36, wherein:

the at least one of the inlet pipe and the outlet pipe is inserted so far that the pipe via the cone interacting with the mating cone is supported on the silencer insert with axial preload;

the at least one of the inlet pipe and the outlet pipe is fastened to the jacket and is supported on the silencer insert axially preloaded.

38. A silencer for a motor vehicle exhaust system of a combustion engine, the silencer comprising:

two end face bottoms facing away from each other;

a closed circumferential jacket;

a silencer insert;

an inlet pipe;

an outlet pipe, at least one of said inlet pipe and said outlet pipe extending through the jacket into a silencer interior and being fastened to said jacket, said pipe extending through said jacket has a cone, said cone being integrally connected to said pipe extending through said jacket, said silencer insert having an intermediate pipe having a mating cone, said mating cone being integrally connected to said mating cone, said cone engaging said mating cone, wherein said intermediate pipe is in direct contact with said pipe extending through said jacket via said cone and said mating cone.

39. A silencer according to claim 38, wherein said jacket contacts said silencer insert in a preloaded manner.

* * * * *

UNITED STATES PATENT AND TRADEMARK OFFICE

CERTIFICATE OF CORRECTION

PATENT NO. : 8,292,026 B2
APPLICATION NO. : 13/101365
DATED : October 23, 2012
INVENTOR(S) : Thomas Tauschek et al.

It is certified that error appears in the above-identified patent and that said Letters Patent is hereby corrected as shown below:

On the Title Page, Item 75:

It is requested that the name of Inventor GEORGE Wirth be changed to read GEORG Wirth.

Signed and Sealed this
Twenty-second Day of April, 2014

Michelle K. Lee

Michelle K. Lee
*Deputy Director of the United States Patent and Trademark Office*